US005447456A

United States Patent [19]

Nakayasu

[11] Patent Number: 5,447,456

[45] Date of Patent: Sep. 5, 1995

[54] POWER STEERING SYSTEM FOR WATERCRAFT

[75] Inventor: Yoshikazu Nakayasu, Hamamatsu, Japan

[73] Assignee: Sanshin Kogyo Kabushiki Kaisha, Hamamatsu, Japan

[21] Appl. No.: 187,840

[22] Filed: Jan. 28, 1994

[30] Foreign Application Priority Data

Jan. 29, 1993 [JP] Japan ..... 5-34508

[51] Int. Cl.[6] ..... B63H 25/42

[52] U.S. Cl. ..... 440/61; 114/150

[58] Field of Search ..... 60/385, 386; 114/150; 440/61

[56] References Cited

U.S. PATENT DOCUMENTS

| | | | |
|---|---|---|---|
| 2,667,746 | 2/1954 | Kumpf et al. | 60/385 |
| 2,855,755 | 10/1958 | Auger | 114/150 |
| 3,302,604 | 2/1967 | Stuteville | 114/150 |
| 4,592,732 | 6/1986 | Ferguson | 440/61 |
| 4,892,494 | 1/1990 | Ferguson | 440/61 |
| 5,032,094 | 7/1991 | Katogi | 440/61 |

FOREIGN PATENT DOCUMENTS

| | | | |
|---|---|---|---|
| 0693532 | 8/1965 | Italy | 114/150 |

*Primary Examiner*—Sherman Basinger
*Attorney, Agent, or Firm*—Knobbe, Martens, Olson & Bear

[57] ABSTRACT

A hydraulic steering system for a marine propulsion outboard drive that includes a manually operated by-pass passage interposed between the fluid chambers of the hydraulic steering motor so as to facilitate manual steering of the outboard drive.

11 Claims, 8 Drawing Sheets

POWER STEERING SYSTEM FOR WATERCRAFT

BACKGROUND OF THE INVENTION

This invention relates to a power steering system for watercraft and, more particularly, to an improved power steering system which facilitates manual control of the watercraft steering without interference from the power steering system.

It is well-known with marine outboard drives, particularly those employing large displacements, to employ a hydraulic power steering system for assisting the operator in steering the watercraft. These systems include a hydraulic cylinder that is connected to the tiller or steering mechanism of the marine outboard drive and which is energized in response to operator control so as to effect power steering of the outboard drive.

These systems are very desirable in that the steering forces for large outboard drives can be quite large and non-assisted steering can, at times, be difficult. However, when a power steering system of the type described is employed, then it is difficult for the operator to manually position the outboard drive. There are times when manual positioning of the outboard drive may be desirable either when the power steering system becomes somehow defective, for servicing or other reasons. However, because of the connection of the hydraulic motor to the steering mechanism for the outboard drive, the operator must manually force the fluid through the hydraulic system in order to effect manual steering. This is obviously a disadvantage.

Although the arrangement may permit disconnection of the hydraulic cylinder or motor from the tiller, this is a cumbersome activity and then requires reinstallation which is not at all desirable.

These problems can be best understood by reference to FIGS. 1–3 of the drawings which show, respectively, a marine outboard drive attached to the transom of a watercraft; a perspective view showing the hydraulically assisted steering mechanism and a hydraulic circuit diagram for the conventional prior art type of construction.

Referring first to FIGS. 1 and 2, an outboard motor that is steered in accordance with both the prior art constructions and which may be steered in accordance with an arrangement employing one of the embodiments of this invention is identified generally by the reference numeral 11. Although the description relates to an outboard motor, it is to be understood by those skilled in the art that both the prior art type of systems and systems embodying the invention may be employed with other types of marine outboard drive such as the outboard drive unit of an inboard/outboard drive. Thus, the term outboard drive, as employed herein, is intended to encompass either the outboard drive portion of such an inboard/outboard drive or an outboard motor per se.

The outboard motor 11 includes a power head, indicated generally by the reference numeral 12 which is comprised of a powering internal combustion engine of any known type and a surrounding protecting cowling. As is typical with outboard motor practice, the driving internal combustion engine is supported so that its output shaft rotates about a vertically extending axis and drives a drive shaft (not shown) rotatably journalled within a drive shaft housing 13 which depends from the power head 12. The drive shaft housing 13 terminates in a lower unit 14 that contains a conventional forward neutral reverse transmission for driving a propulsion device such as a propeller 15 in a manner well-known in this art.

A steering shaft 16 (FIG. 2) is affixed to the drive shaft housing 13 in any known manner and is journalled for steering movement about a generally vertically extending steering axis within a swivel bracket 17. A tiller 18 is affixed to the upper end of the steering shaft 16 and extends forwardly across the transom 19 of an associated watercraft 21 for steering movement in a manner which will be described.

The swivel bracket 17 is connected by means of a horizontally extending tilt pin 22 to a clamping bracket 23 that is affixed to the transom of the associated watercraft in a well-known manner. This pivotal connection permits tilt and trim movement of the outboard motor 11.

This tilt and trim movement may be controlled hydraulically by means of a tilt cylinder 24 that is connected between the clamping bracket 23 and the swivel bracket 17 and a trim cylinder 25 that is carried by the clamping bracket 23 and which has a piston that engages the swivel bracket 17. This type of hydraulic tilt and trim control is well-known in the art as is the remainder of the construction of the outboard motor 11. Since the invention deals primarily with the steering mechanism, further description of the details of the outboard motor 11 are not believed to be necessary to understand the invention or the disadvantages of the prior art.

The steering mechanism will now be described again by reference primarily to FIGS. 1 and 2, although most of the details of the steering mechanism appear in FIG. 2 wherein the steering mechanism is shown in perspective view. This steering mechanism includes a steering control such as a steering wheel 26 that is mounted in the hull 21 forwardly of the transom 19 in a known manner. The steering wheel 26 is affixed to at a pinion gear 27 that is enmeshed with a rack 28 slidably supported within a housing 29.

One end of a wire bowden wire transmitter 31 is connected to the rack 28 and is surrounded by a protective sheathing. The other end of the wire actuator is mounted within a support tube 32 and has a rod or piston 33 affixed to its outer end which is connected to a mechanism, indicated generally by the reference numeral 34 for transmitting steering movement from the steering wheel 26 to the tiller 18. This mechanism includes a cross bar 35 that is pivoted to one end of the rod 33 and which is pivotally connected, by means of a pivot pin 36 to a steering arm 37. The other end of the steering arm 37 is connected to the tiller 18 by a connector 38.

The mechanism for steering further includes a hydraulic assist that includes a hydraulic cylinder 39 having a piston, to be described, that has a piston rod 41 affixed to one end and which is connected to the cross bar 35 for actuating it. A control valve assembly 42 is also mounted on the cylinder 39 and is actuated in response to steering imputs from the wire actuator 31 in a manner as described in the copending application entitled "Steering System for Marine Propulsion Unit," Ser. No. 08/014,650, filed Feb. 8, 1993 in the name of Eiichiro Tsujii and Akihiro Onoue, which application is assigned to the assignee hereof now issued as U.S. Letters Pat. No. 5,330,375. The disclosure of that reference is incorporated herein by reference.

The prior art type of hydraulic circuitry by which the fluid motor 39 is energized may be best understood by reference to FIG. 3, which is a schematic hydraulic diagram. It will be seen that the fluid motor 39 is comprised of a cylinder 43 that defines a cylinder bore 44 in which the aforenoted piston 45 is slidably supported. The piston 45 is, as noted, connected to the piston rod 41. The piston 45 divides the cylinder bore 44 into a pair of fluid chambers 46 and 47 with the piston rod 41 extending through the chamber 47.

The control valve 42 is depicted as being of a three-position two-way valve and is shown in its neutral position in FIG. 3. In this condition, conduits 48 and 49 which extend to the chambers 46 and 47, respectively, are closed off.

The system further includes a remotely positioned fluid power source that includes a reservoir 51 in which hydraulic fluid is contained and which is drawn through a conduit 52 by a pump 53. The pump 53 is driven by an electric motor 54 and discharges fluid under pressure to a supply port 55 in which a check valve 56 is provided. This check valved port 55 communicates with a first port 57 of the valve 42.

A return conduit 58 is provided in the supply port 55 and a pressure relief valve 59 is positioned in this line so as to limit the amount of pressure build-up in the port 55 by bypassing fluid back to the reservoir 51.

The valve 42 also has a return port 61 that communicates with the reservoir 51 through a return line 52.

The control valve 42 is shifted from the neutral position shown in FIG. 3 to either a right-hand or left-hand steering position depending upon the steering inputs by the steering wheel 26. When the valve 42 is shifted to the right as seen in FIG. 3, the port 57 communicates with the conduit 48 and the fluid motor chamber 46 is pressurized. At the same time, the chamber 47 is connected to the return line 62 by the valve 42 so that fluid can be displaced from the chamber 47 back to the reservoir 51. Since the piston rod 41 extends through the chamber 47, more fluid will be required to fill the chamber 46 and it is displaced from the chamber 47 and this make-up fluid is drawn from the reservoir 51 as is well-known. When the piston rod 41 is moved to the right, the outboard motor 11 will be pivoted in a counter-clockwise direction and will effect the steering of the associated watercraft to the right.

When left-hand steering is called for, the valve 42 is moved in the opposite direction so that the line 49 is pressurized and the line 48 is the return line. Fluid then fills the chamber 47 and is displaced from the chamber 46 to cause the piston 45 to move to the left as shown in FIG. 3.

It should be readily apparent from a review of FIG. 3 that although hydraulic-assisted steering is possible, if the operator wishes to manually steer the outboard motor 11 either by pushing on the tiller 18 or the outboard motor 11 itself, the fluid motor 39 will act as a hydraulic lock against such movement. As a result, manual steering is difficult if not impossible.

It is, therefore, a principal object of this invention to provide an improved arrangement for a hydraulically steered outboard drive wherein manual steering can be accomplished if desired.

It is a further object of this invention to provide an arrangement wherein a hydraulic steering mechanism for a marine outboard drive may be manually bypassed to permit manual steering movement of the outboard drive.

SUMMARY OF THE INVENTION

This invention is adapted to be embodied in a steering arrangement for a marine outboard drive that is comprised of a driveshaft housing and lower unit which are adapted to be affixed to the transom of a watercraft for steering movement about a generally vertically extending steering axis. The lower unit contains a propulsion device for propelling the watercraft. Tiller means are affixed to the outboard drive and a fluid motor having a pair of opposed fluid chambers as operably connected to the tiller means for effecting steering movement of the outboard drive about the steering axis upon pressurization of one or the other of the fluid chambers. A hydraulic supply circuit supplies fluid under pressure to selected ones of the chambers and for exhausting fluid from the other of the chambers in response to operator demand. A bypass passage communicates the fluid chambers of a fluid motor with each other and manually operable valve means are provided in the bypass passage for controlling the communication of the chambers to facilitate manual steering by opening of the communication.

DETAILED DESCRIPTION OF THE PREFERRED EMBODIMENTS OF THE INVENTION

Figure 1:
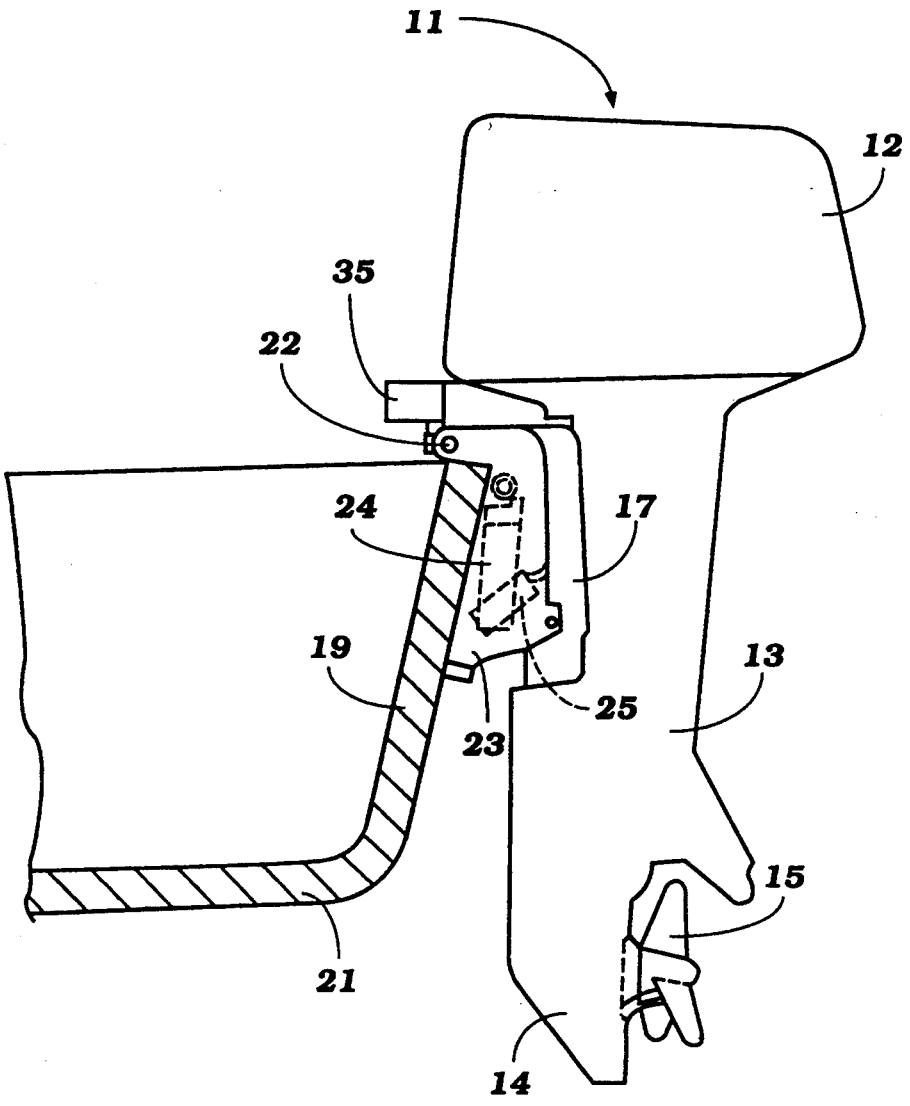
FIG. 1 is a side elevational view of an outboard motor attached to the transom of an associate watercraft, shown partially and in cross section to illustrate the environment in which the invention may be employed.
Figure 2:
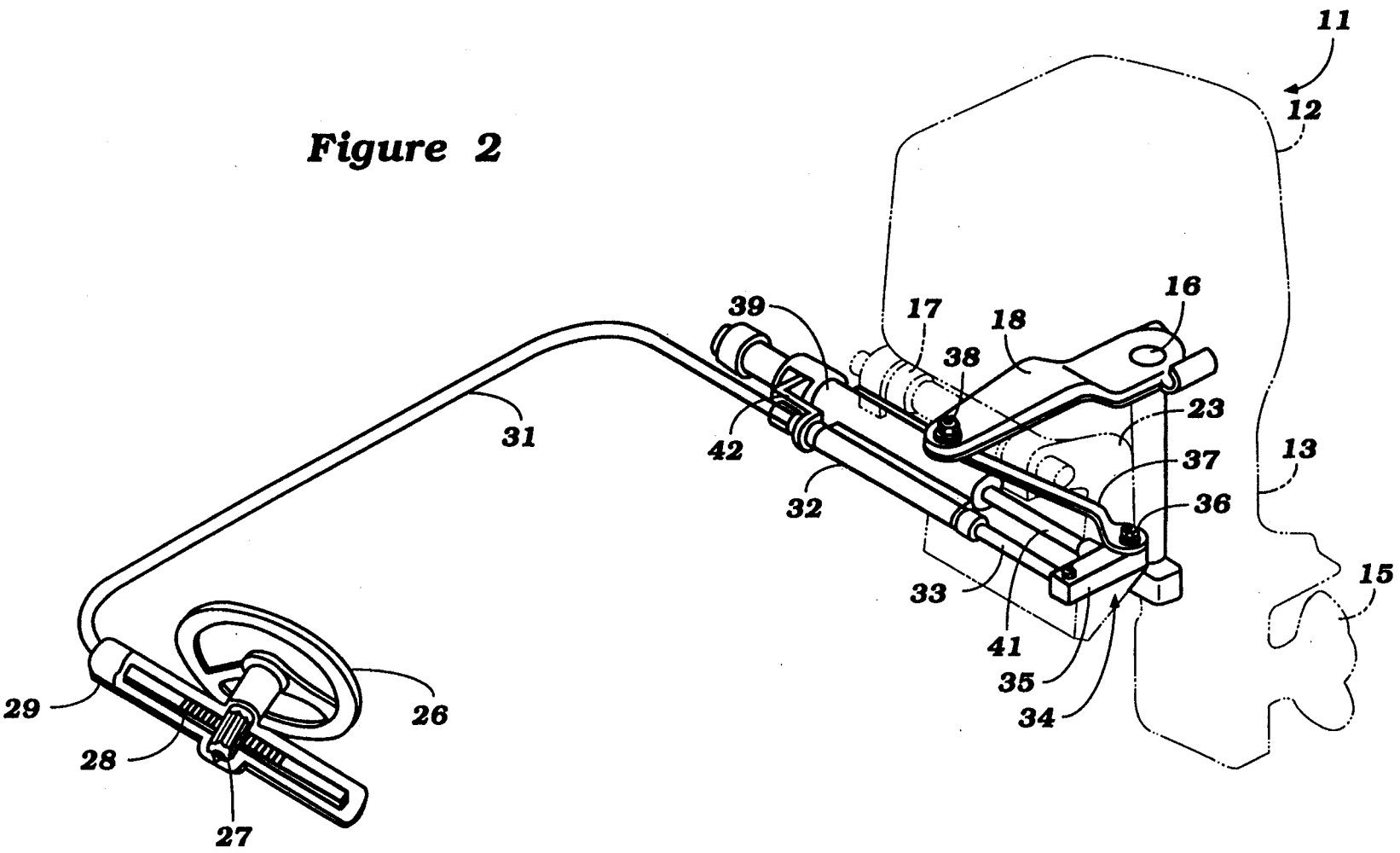
FIG. 2 is a perspective view of the steering system for the outboard drive with the outboard drive being shown in phantom.
Figure 3:
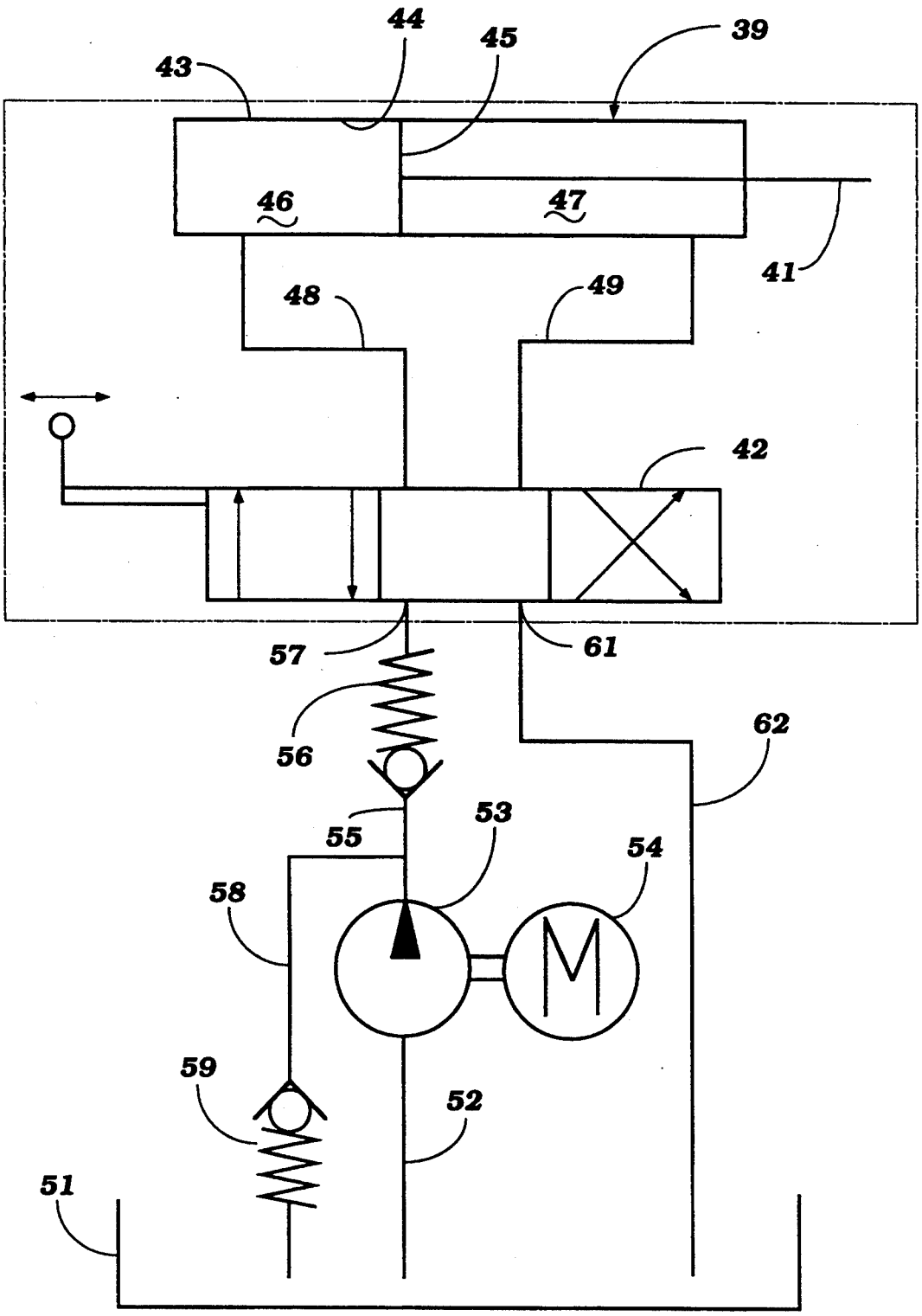
Figure 3 Prior Art
FIG. 3 is a circuit diagram showing the conventional prior art type of construction for operating the hydraulic steering mechanism.

In describing each of the embodiments of the invention, only a description of the circuit diagram is believed to be necessary to permit those skilled in the art to practice the invention. The environment in which the invention may be practiced is as shown in FIGS. 1 and 2 and the aforenoted copending application. Therefore, all that is believed to be necessary to permit those skilled in the art to practice the invention is the way in which the fluid chambers 46 and 47 of the fluid motor 39 can be communicated with each other so as to relieve the hydraulic pressure and facilitate manual steering. Since the described embodiments incorporate a number of components which are the same as the conventional systems, the circuit diagrams of FIGS. 4 through 8 use the same reference numerals as with the description of the prior art in FIG. 3 when those components are the same or substantially the same.

Figure 4:
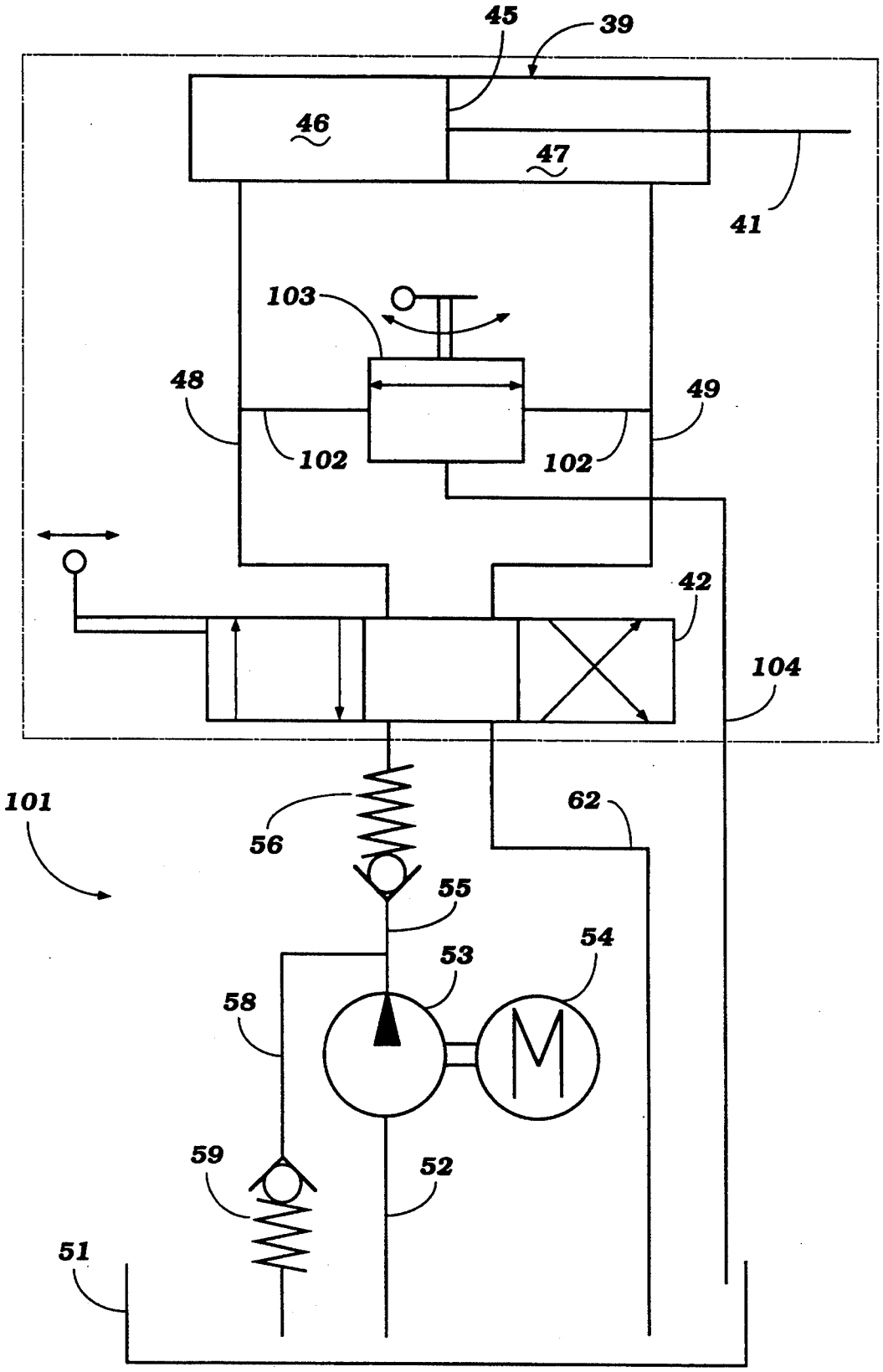
FIG. 4 is a schematic view of a circuit diagram constructed in accordance with a first embodiment of the invention.

Referring now in detail first to the embodiment of FIG. 4, a hydraulic circuit constructed in accordance with this embodiment is identified generally by the reference numeral 10I. The structure is basically the same as the prior art type of construction shown in FIG. 3 but in this embodiment a bypass passage 102 extends between the conduits 48 and 49 that connect the valve assembly 42 to the chambers 46 and 47 of the fluid motor 39. A bypass valve 103 as provided in this line 102 and is depicted as being of an on/off type of valve and is shown in its closed position. In this closed position, the system will operate as with the prior art type of construction and, for that reason, further description of this power steering mode is not believed to be necessary to permit those skilled in the art to understand the invention.

If, however, the operator desires to move the outboard 11 about its steering axis manually, the valve 103 is moved from its closed position as shown in FIG. 4 to an open position wherein the conduit 102 permits the conduits 48 and 49 to communicate with each other. Hence, the motor can be steered manually and if it is moved so that the piston rod 41 is moved inwardly or to the left as shown in FIG. 4, fluid will be displaced from the chamber 46 through the bypass passage 102 and open valve 103 to the conduit 49 and chamber 47. It should be noted, however, that more fluid will be displaced from the chamber 46 then required to make up the fluid in chamber 47 due to the fact that the piston rod 41 extends through the chamber 47. This excess fluid is bypassed from the valve 103 back to the reservoir 51 through an internal line 104 which is also open when the valve 103 is in its open position.

If manual movement in the opposite direction is required, then the piston 45 will be moved to the right and fluid is displaced from the chamber 47 to the chamber 46. There will be insufficient fluid to displace from the chamber 47 to fill the chamber 46 and the conduit 104 permits fluid to be drawn from the reservoir 51 to make up this fluid when this movement is desired. When the operator wishes to return to automatic or power steering control, the valve 103 is again closed.

Figure 5:
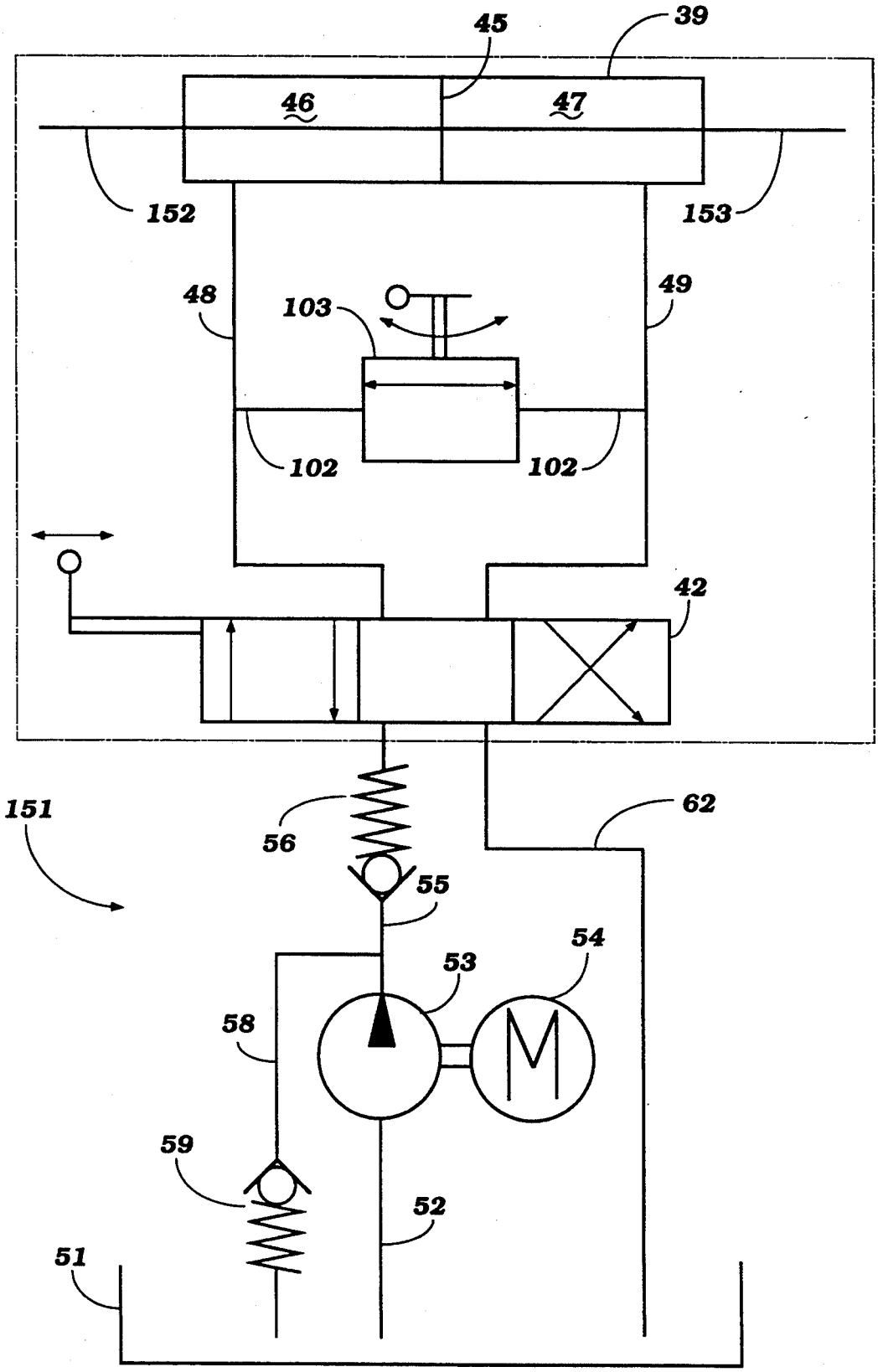
FIG. 5 is a schematic view of a circuit diagram in accordance with a second embodiment of the invention.

FIG. 5 shows another embodiment of the invention which is identified generally by the reference numeral 151 and which is substantially the same as the embodiment of FIG. 4. In this embodiment, however, the make-up line 104 can be eliminated because the piston 45 is provided with a pair of piston rods 152 and 153 which extend through the chambers 46 and 47, respectively so that equal amounts of fluid will be displaced from each chamber regardless of the direction of movement. In all other regards this embodiment is the same as that previously described and, for that reason, further description of this embodiment is not believed to be necessary to permit those skilled in the art to practice the invention.

Figure 6:
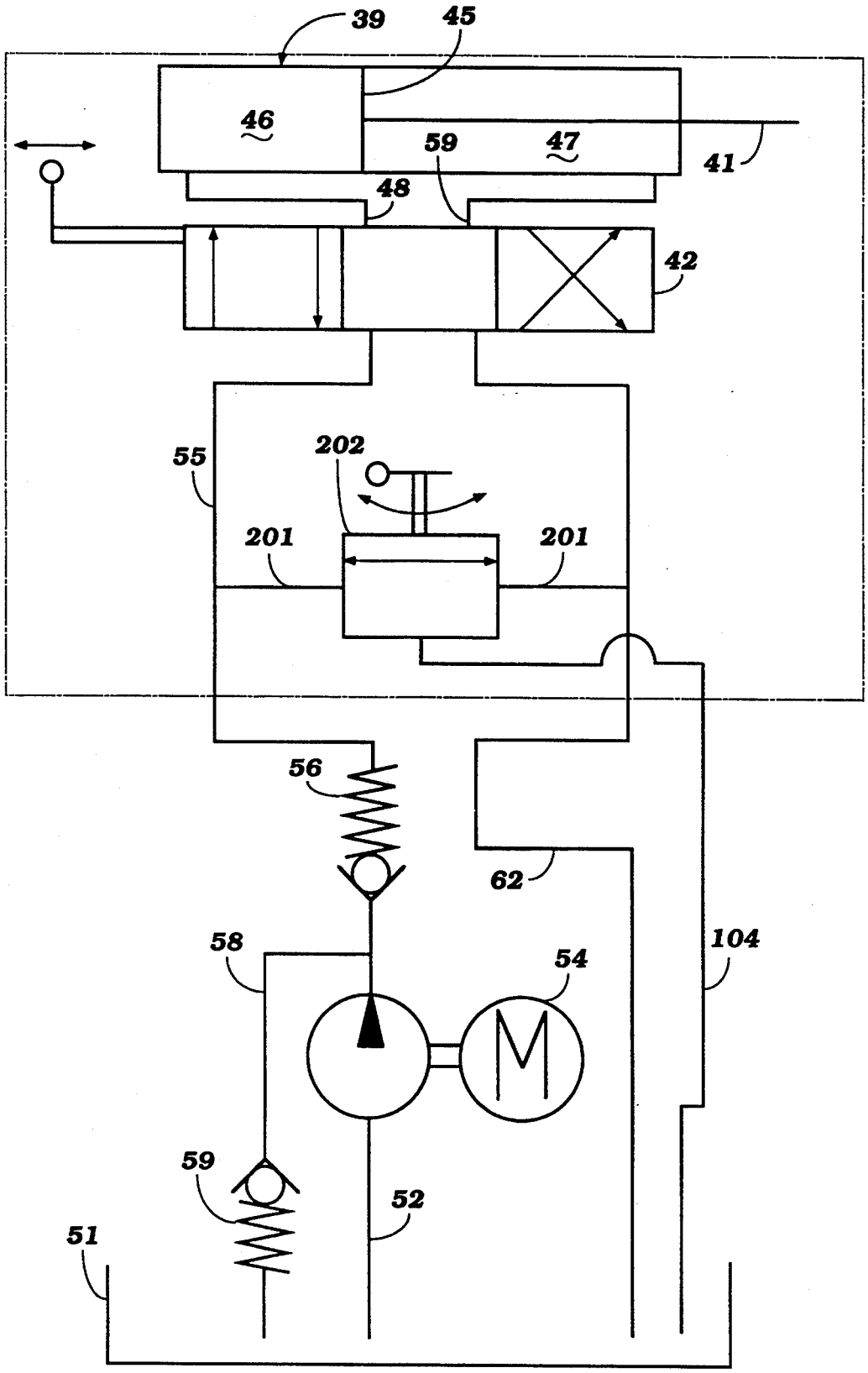
FIG. 6 is a schematic view of a circuit diagram in accordance with a third embodiment of the invention.

In the embodiments as thus far described the bypass conduit and bypass control valve has been disposed between the steering control valve 42 and the fluid motor 39. FIG. 6 shows another embodiment of the invention wherein the bypass valve is disposed between the fluid pump 53 and the steering control valve 42. Except for this difference, the construction of this embodiment is the same as that already described and, for that reason, components of this embodiment that are the same or substantially the same as those previously described have been identified by the same reference numerals and will be described again only insofar as is necessary to understand the construction and operation of this embodiment.

In this embodiment, a bypass conduit 201 ms positioned to extend between the pump outlet port 55 and the return conduit 62. A manually operated bypass valve 202 is provided so as to control the flow through the bypass conduit 201. With this embodiment, in addition to opening the bypass valve 202 to permit manual steering, the control valve 42 must be shifted to one of its two positions so that fluid can flow between the chambers 46 and 47 through the bypass line 201. Like the embodiment of FIG. 4, there must also be provided a make-up line 104 that connects with the bypass valve 202 when opened so as to accommodate the changes in displacement of the piston rod 41. It should be noted that it will not be necessary for the operator to manually position the valve 42 if he attempts to effect steering by turning of the steering wheel 26, since this will automatically position the control valve 42 in the desired position for permitting the fluid flow.

Figure 7:
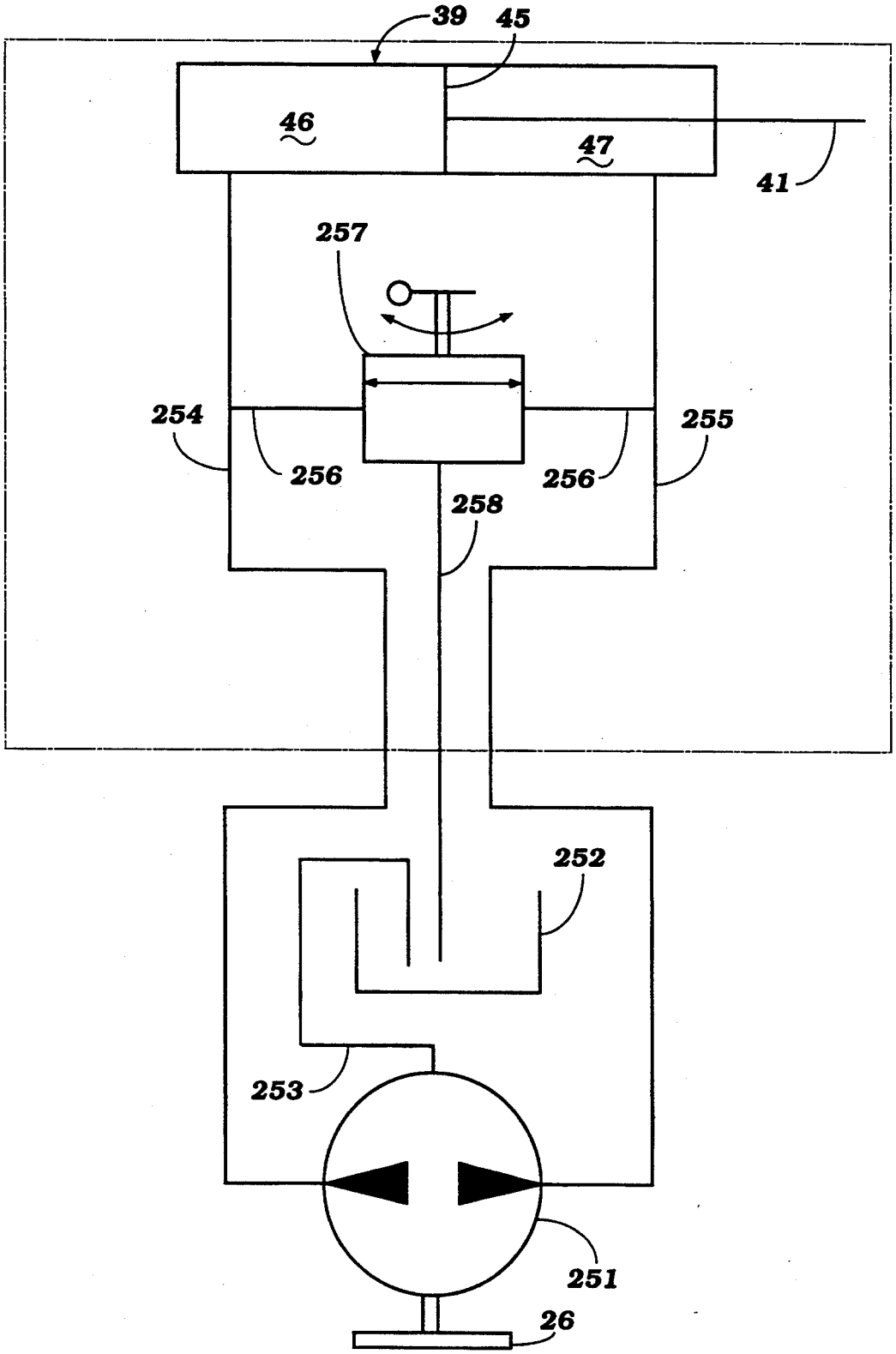
FIG. 7 is a schematic view of a circuit diagram in accordance with a fourth embodiment of the invention.

In the embodiments of the invention as thus far described, the steering system for the outboard drive has been of the follow-up type in that there is a mechanical linkage system that steers the outboard motor 11, and the hydraulic assist is of the follow-up type. However, the invention may also be employed in conjunction with pure hydraulically operated steering mechanisms, and FIG. 7 shows such an embodiment.

In this embodiment, the steering wheel 26 is connected to a manually operated fluid pump 251 that draws fluid from a reservoir 252 through a supply conduit 253 and pressurizes either of a pair of conduits 254 and 255, which go to the fluid motor chambers 46 and 47, respectively. If the steering wheel 256 is rotated so that the manually operated pump 251 pressurizes the line 254, fluid will be delivered from the reservoir 252 to the fluid chamber 46 to move the piston 45 to the right. Fluid will be displaced from the chamber 47 back to the inlet side of the pump 251 through the conduit 255. With this condition and as has been previously noted, the amount of fluid displaced from the chamber 47 will be less than that required for the chamber 46 due to the fact that the piston rod 41 only extends through the chamber 47. Under this condition, make-up fluid is supplied from the reservoir 252 through the conduit 253.

When steering in the opposite direction, more fluid will be displaced from the chamber 46 than need be supplied to the chamber 47, again due to the presence of the piston rod 41 in the chamber 47. This excess fluid displaced is returned back to the reservoir 252 through the make-up conduit 253.

In this embodiment, manual steering will be difficult because the operator must force fluid through the pump 251 to effect the manual steering. Therefore, there is provided a bypass conduit 256 that extends between the conduits 254 and 255 and in which a manually operated bypass valve 257 is provided. In order to provide make-up fluid for the different displacement of the piston rod 41, a make-up conduit 258 is also supplied with the valve 257 and connects the valve to the reservoir 252 in a manner that is believed to be apparent.

Figure 8:
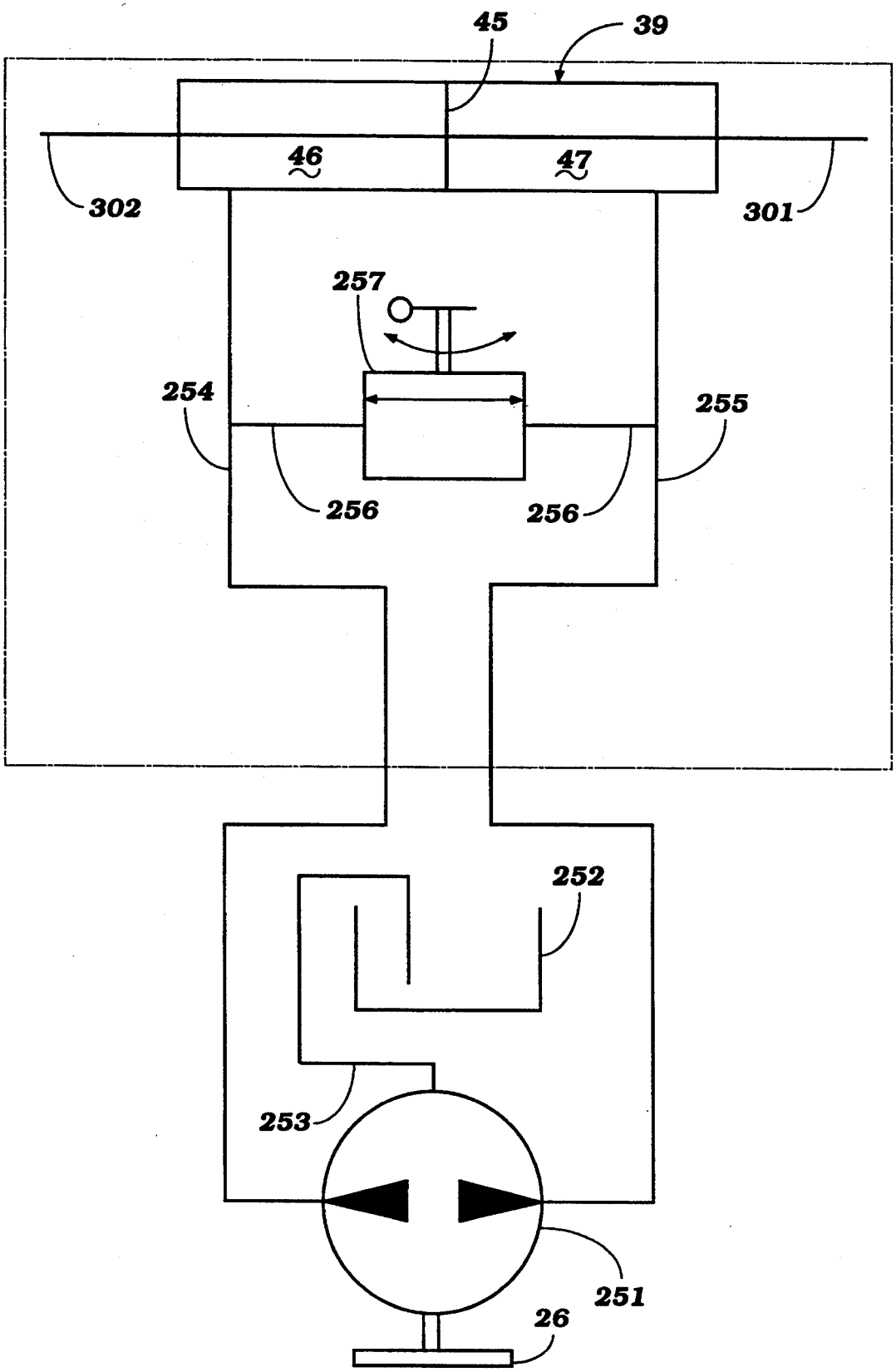
FIG. 8 is a schematic view of a circuit diagram in accordance with a fifth embodiment of the invention.

FIG. 8 shows another embodiment that is generally similar to the embodiment of FIG. 7 but in which the makeup conduit 258 is not required because in this embodiment the piston rod has rod sections 301 and 302 that extend through the chambers 47 and 46, respectively, so that equal amounts of fluid will be displaced from both chambers upon movement.

It should be readily apparent from the foregoing description that the described embodiments of the invention are extremely effective in providing hydraulic steering but at the same time permitting the hydraulic system to be bypassed so as to accommodate manual steering if desired. Of course, the described embodiments are preferred embodiments of the invention, but various changes and modifications may be made without departing from the spirit and scope of the invention, as defined by the appended claims.

I claim:

1. A steering arrangement for a marine outboard drive comprised of a drive shaft housing and lower unit adapted to be affixed to the transom of a watercraft for steering movement about a generally vertically extending steering axis, said lower unit containing a propulsion device for propelling said watercraft, tiller means affixed to said outboard drive, a manual steering control spaced from said marine outboard drive, a mechanical connection for coupling said manual steering control to said tiller means for manual steering of said marine outboard drive, a fluid motor having a pair of opposed fluid chambers and operably connected to said tiller means for assisting steering movement of said outboard drive about said steering axis upon the pressurization of one or the other of said fluid chambers, a hydraulic supply circuit including a steering control valve operated by said mechanical connection for supplying fluid under pressure to a selected one of said chambers and for exhausting fluid from the other of said chambers in response to operator demand, a bypass passage communicating said fluid chambers of said fluid motor with each other, and a single manually operable bypass valve in said bypass passage for opening the communication between said chambers for permitting manual steering of the outboard motor without hydraulic resistance.

2. The steering arrangement for a marine outboard drive of claim 1, wherein the hydraulic supply circuit comprises a fluid pump for supplying fluid under pressure to the chambers of the fluid motor.

3. The steering arrangement for a marine outboard drive of claim 2, wherein the bypass passage and bypass valve are disposed in the fluid circuit between the fluid pump and the fluid motor.

4. The steering arrangement for a marine outboard drive of claim 3, wherein the fluid motor comprises a cylinder having a piston received therein and dividing the cylinder into the pair of chambers and further including a piston rod affixed to said piston and extending through only one of the chambers.

5. The steering arrangement for a marine outboard drive of claim 4, wherein the bypass valve further includes a make-up passage communicating the bypass passage with a fluid reservoir for accommodating for differences in the displacement of the piston rod in the one fluid chamber.

6. The steering arrangement for a marine outboard drive of claim 2, wherein the bypass passage and the bypass valve are disposed between the pump and the steering control valve.

7. The steering arrangement for a marine outboard drive of claim 6, wherein the fluid motor comprises a cylinder having a piston received therein and dividing the cylinder into the pair of chambers and further including a piston rod affixed to said piston and extending through only one of the chambers.

8. The steering arrangement for a marine outboard drive of claim 7, wherein the bypass valve further includes a make-up passage communicating the bypass passage with a fluid reservoir for accommodating for differences in the displacement of the piston rod in the one fluid chamber.

9. The steering arrangement for a marine outboard drive of claim 1, wherein the bypass passage and bypass valve are disposed between the steering control valve and the fluid motor.

10. The steering arrangement for a marine outboard drive of claim 9, wherein the fluid motor comprises a cylinder having a piston received therein and dividing the cylinder into the pair of chambers and further including a piston rod affixed to said piston and extending through only one of the chambers.

11. The steering arrangement for a marine outboard drive of claim 10, wherein the bypass valve further includes a make-up passage communicating the bypass passage with a fluid reservoir for accommodating for differences in the displacement of the piston rod in the one fluid chamber.

* * * * *